US009435156B2

(12) United States Patent
Kerr

(10) Patent No.: US 9,435,156 B2
(45) Date of Patent: Sep. 6, 2016

(54) DUAL TRACK LADDER WITH BRAKE MECHANISM THAT IS AUTOMATICALLY APPLIED TO THE UPPER TRACKS TO HOLD THE LADDER IN PLACE DURING USE

(71) Applicant: MATERIAL CONTROL, INC., Croswell, MI (US)

(72) Inventor: James F. Kerr, Croswell, MI (US)

(73) Assignee: Material Control, Inc., Croswell, MI (US)

( * ) Notice: Subject to any disclaimer, the term of this patent is extended or adjusted under 35 U.S.C. 154(b) by 47 days.

(21) Appl. No.: 14/107,218

(22) Filed: Dec. 16, 2013

(65) Prior Publication Data

US 2014/0097039 A1 Apr. 10, 2014

Related U.S. Application Data

(63) Continuation of application No. 12/814,961, filed on Jun. 14, 2010, now Pat. No. 8,622,171, which is a continuation of application No. 12/157,260, filed on Jun. 9, 2008, now Pat. No. 7,757,813.

(51) Int. Cl.

| | |
|---|---|
| ***E06C 9/12*** | (2006.01) |
| ***E06C 1/397*** | (2006.01) |
| ***E06C 7/18*** | (2006.01) |

(52) U.S. Cl.

CPC ..... *E06C 9/12* (2013.01); *E06C 1/397* (2013.01); *E06C 7/182* (2013.01); *E06C 7/183* (2013.01)

(58) Field of Classification Search

CPC ..... E06C 9/12; E06C 1/397; E06C 7/183; E06C 7/182; A47B 96/00

USPC ..... 182/17, 38, 39, 15, 97, 80, 84, 115, 36, 182/37, 83, 85, 12; 188/1.12, 29, 43, 57, 188/62, 67, 74, 76, 84, 85, 184–188, 207, 188/210, 139; 104/91, 93

See application file for complete search history.

(56) References Cited

U.S. PATENT DOCUMENTS

| | | | |
|---|---|---|---|
| 356,375 | A | 1/1887 | Perkins |
| 470,374 | A | 3/1892 | Fisher |
| 528,824 | A | 11/1894 | Sumner |
| 775,488 | A | 11/1904 | Tetzlaff |
| 907,401 | A | 12/1908 | Prouty |
| 1,320,740 | A | 11/1919 | Coghlin |
| 1,341,996 | A | 6/1920 | Plucienski |
| 1,431,921 | A | 10/1922 | Barnes |

(Continued)

OTHER PUBLICATIONS

Cotterman Company, Bulletin No. WL-185 for "Rolling Wood Ladders".

(Continued)

*Primary Examiner* — Daniel Cahn
(74) *Attorney, Agent, or Firm* — Dykema Gossett PLLC

(57) ABSTRACT

A ladder system includes an overhead track system, a ladder, a latch and a carriage. The overhead track system includes a first guide track and a second guide track. The carriage is operatively configured to move longitudinally along the first and second guide tracks and to move laterally between the first and second guide tracks. The ladder is pivotally mounted to the overhead track system. A lateral carriage brake is provided which prevents lateral movement of the ladder, and a longitudinal carriage brake is provided to prevent longitudinal movement of the ladder. The latch is operatively configured to affix the ladder to the carriage.

16 Claims, 10 Drawing Sheets

(56) References Cited

U.S. PATENT DOCUMENTS

| | | | | |
|---|---|---|---|---|
| 1,658,192 | A * | 2/1928 | Hampton | 188/42 |
| 1,972,367 | A * | 9/1934 | Willard | 188/42 |
| 2,273,124 | A | 2/1940 | McDaniels | |
| 3,338,195 | A | 8/1967 | Kobelt | |
| 4,153,138 | A | 5/1979 | Walberg | |
| 4,545,575 | A | 10/1985 | Forjot | |
| 5,082,086 | A | 1/1992 | Kerr | |
| 5,148,889 | A * | 9/1992 | Fenwick et al. | 182/17 |
| 5,413,191 | A | 5/1995 | Kerr | |
| 5,480,002 | A | 1/1996 | Kerr | |
| 5,653,307 | A | 8/1997 | Kerr | |
| 5,685,227 | A | 11/1997 | Gaccetta et al. | |
| 5,921,604 | A | 7/1999 | Yu et al. | |
| 6,129,179 | A | 10/2000 | Rooney et al. | |
| 6,230,841 | B1 | 5/2001 | Valore | |
| 6,619,427 | B1 * | 9/2003 | Kerr | 182/39 |
| 7,484,461 | B2 | 2/2009 | Britcher | |
| 7,757,813 | B2 | 7/2010 | Kerr | |
| 8,622,171 | B2 | 1/2014 | Kerr | |
| 2006/0225954 | A1 * | 10/2006 | Sayles | 182/20 |

OTHER PUBLICATIONS

Putnam Rolling Ladder Co., Inc., "Telephone Ladders" [online] [retrieved May 12, 2008]. Retrieved from the internet: <URL: http://www.putnamrollingladder.com/telephone.html>.

Putnam Rolling Ladder Co., Inc., excerpt from catalog re "Telephone Ladders."

U.S. Appl. No. 14/107,218, filed Dec. 16, 2013.

* cited by examiner

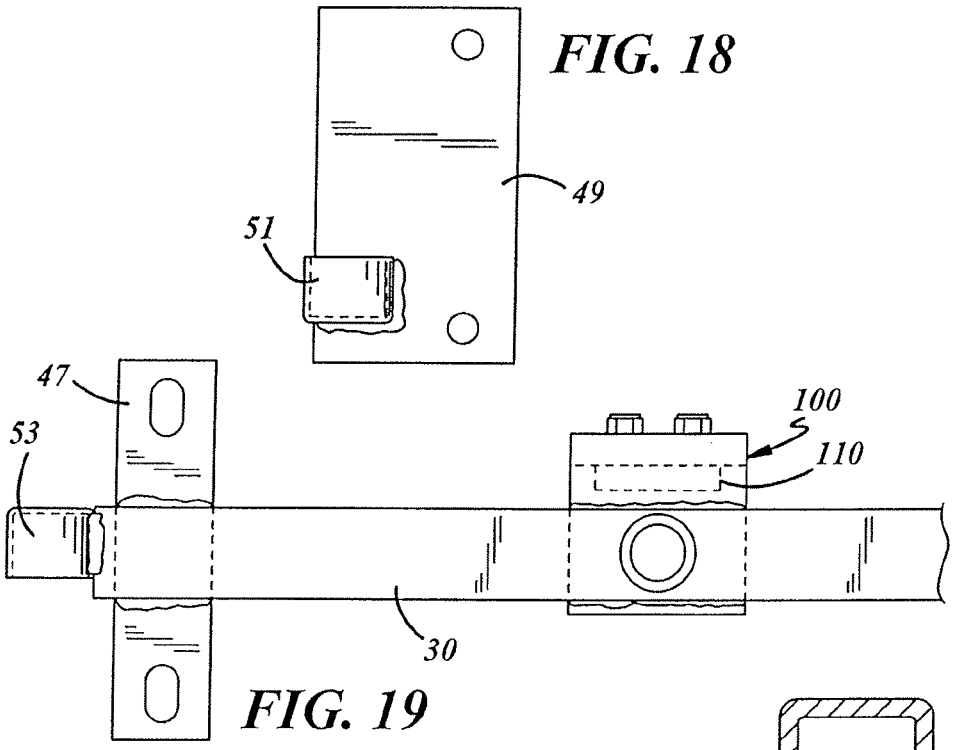
FIG. 18
FIG. 19
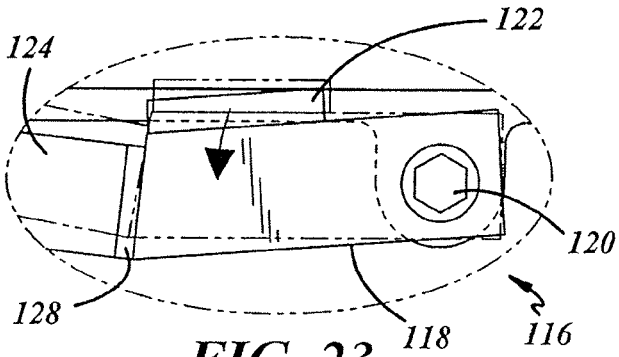
FIG. 23
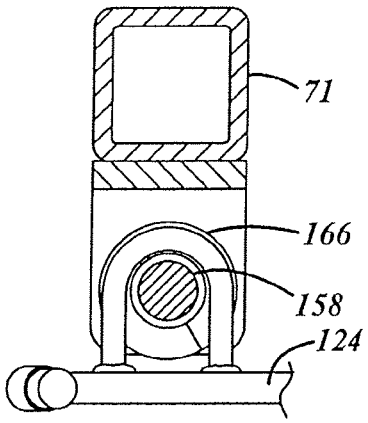
FIG. 22
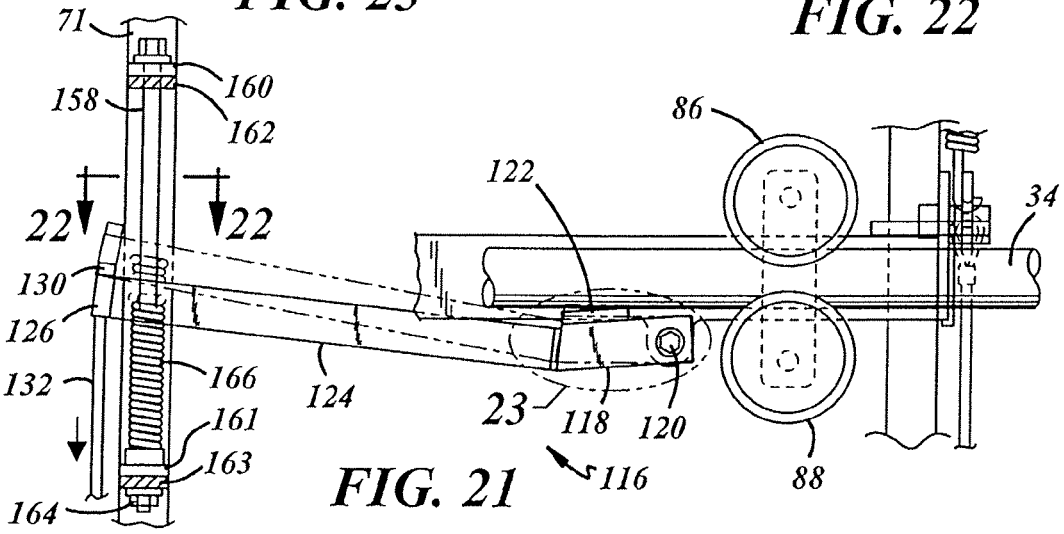
FIG. 21

DUAL TRACK LADDER WITH BRAKE MECHANISM THAT IS AUTOMATICALLY APPLIED TO THE UPPER TRACKS TO HOLD THE LADDER IN PLACE DURING USE

RELATED PATENT APPLICATIONS

This application is a continuation of U.S. patent application Ser. No. 12/814,961 (the '961 application), filed 14 Jun. 2010, now pending, which is a continuation of patent application Ser. No. 12/157,260 (the '260 application), filed 9 Jun. 2008, issued on 20 Jul. 2010 as U.S. Pat. No. 7,757,813 (the '813 patent). The '961 application and the '260 application are both hereby incorporated by reference as though fully set forth herein.

BACKGROUND

This application relates to a ladder system used between a pair of laterally spaced apart storage shelves located in a store or warehouse. Applicant's prior U.S. Pat. No. 5,413,191, issued May 9, 1995, entitled "DUAL TRACK LADDER" and U.S. Pat. No. 6,619,427, issued Sep. 16, 2003, entitled "FOLDABLE DUAL TRACK LADDER" disclose ladder systems which have been commercially successful. The existing dual track ladders have spring-loaded casters and rubber pads at the lower end of the ladder. When the ladder is in use, the weight of the user or worker is sufficient to compress the caster springs and urge the rubber pads against the floor to thereby lock, secure or immobilize the base of the ladder on the floor.

However, with taller ladders and especially ladders provided with a platform for the user or worker at the top of the ladder, some have found that the construction of the ladder permitted movement of the upper part of the ladder longitudinally parallel to the dual tracks despite the compression of the spring casters at the base of the ladder as in U.S. Pat. No. 6,619,427. Also, it was found that the ladder was slightly unstable on the transverse track or rod forming a part of the roller carriage and thus the top of the ladder could also move slightly laterally or from side to side. Such movements are undesirable.

With the prior art ladders, a person can inch the ladder forward or longitudinally as well as laterally despite the compressed spring-loaded casters at the base. The wheels or rollers on the dual tracks and on the wheels or rollers on the lateral track at the top of the ladder have no restraint and by jerking the ladder forward, a person can move the ladder either intentionally or mistakenly forward as well as laterally from side to side.

SUMMARY

The dual track ladder of the present disclosure incorporates brake mechanisms that are applied automatically to each of the upper tracks by a person on the ladder to hold the ladder in place during use and a separate lateral brake mechanism that is applied by spring tension to the lateral track or rod to hold the ladder in one position on the transverse track until the lateral brake is manually deactivated. Such mechanisms work in conjunction with the spring-loaded casters and rubber pads at the lower end of the ladder. When the ladder is in use, the lateral brake is applied automatically by spring tension, and the weight of the user is thereafter sufficient to compress the spring-loaded casters and lock the base of the ladder to the floor. As the worker progresses up the ladder, whether provided with or without a platform, the weight of the worker automatically applies the brake mechanisms to the upper tracks to hold the ladder in place during use and to prevent the ladder from moving either intentionally or mistakenly forward. The final result is that the ladder is now completely immobilized. Thus, the user can no longer inch the ladder forward hence the wheels of the carriage system on the dual tracks at the top of the ladder are now restrained and prevented from jerking forward, either intentionally or mistakenly forward.

The lateral brake is normally actuated so that the ladder remains in one position on the transverse track until the brake is deactivated. A user desiring to move the ladder transversely pulls an actuating or positioning cable thereby deactivating the brake. The ladder is then moved transversely. At the desired position the cable is released, the brake locks and the ladder is in the new transverse position.

The final result is that the ladder is now completely immobilized. By stepping on the ladder, the casters at the bottom retract and the ladder is locked to the floor. By releasing the positioning cable the ladder is locked in a transverse position. The weight of the person on the ladder locks the carriage to the dual tracks on top. All movement is stopped and the ladder is completely stable.

The present disclosure also constitutes an improvement over U.S. Pat. No. 6,619,427 by providing a gas cylinder which, when a latch is released, pushes the ladder section up and to the right at one side of the aisle. Thus, the ladder comes to rest against the face of the shelving and it is held in that position by the gas cylinder. In order to use the ladder, it is necessary for the ladder to be pushed back manually to the normal position until the latch snaps shut and thereby retains the ladder in position in the aisle ready for use. Such features meet local building codes and regulations.

The brake mechanisms on the dual tracks are spring-loaded and are applied to the rolling carriage on the tracks at the top of the ladder when the user steps on the ladder. Not only are the spring-loaded casters compressed at the base, but also the spring-loaded brakes provided with rubber pads on the tracks at the top of the ladder are compressed and the ladder is thereby held stationary both at the top and at the bottom. Thus, the ladder is completely immobilized.

BRIEF DESCRIPTION OF THE DRAWINGS

FIG. 18 is an elevational view of the side plate provided with a spring cup;

FIG. 19 is a fragmentary elevational view of the mounting bar with a spring cup, a bracket for mounting the rollers and a brake mechanism;

FIG. 21 is a fragmentary elevational view, partly in section and with parts broken away, and looking in the direction of arrows 21-21 of FIG. 7;

FIG. 22 is a sectional view looking in the direction of arrows 22-22 of FIG. 21; and FIG. 23 is an enlarged view of the structure within circle 23 of FIG. 21.

DETAILED DESCRIPTION

Figure 1:
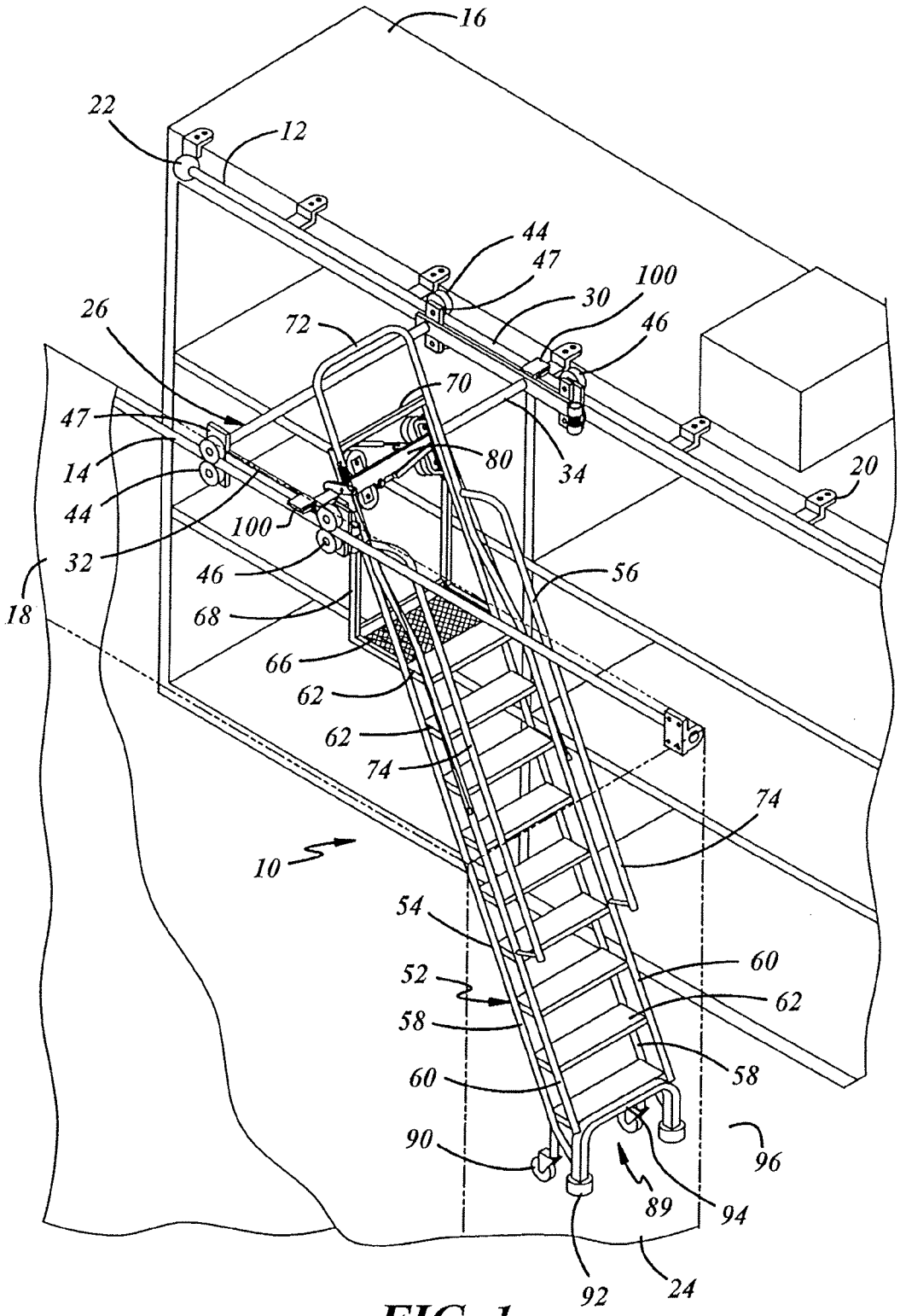
FIG. 1 is a partially cut-away perspective view of a ladder system according to the present disclosure, with the ladder being located in the aisle of a store between laterally spaced apart storage shelves.
Figure 2:
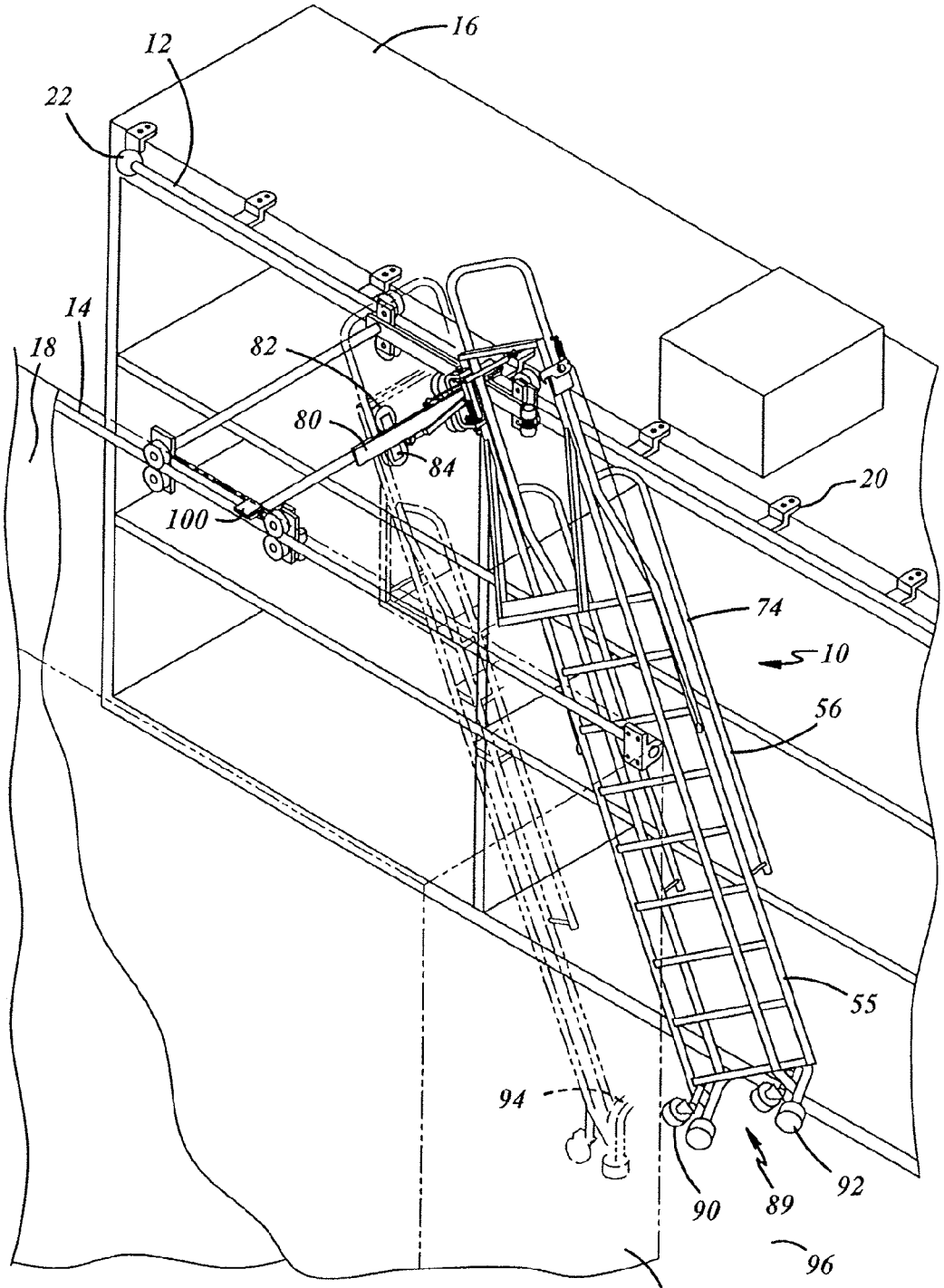
FIG. 2 is a cut-away perspective view of a ladder system according to the present disclosure, similar to FIG. 1, but illustrating the ladder in a folded position against the side of one of the shelves to thereby reduce blockage of the aisle between laterally spaced apart storage shelves.

FIGS. 1 and 2 illustrate the ladder system 10 which includes a pair of dual tracks or rails including a first overhead guide track 12 and a second overhead guide track 14. The dual tracks 12 and 14 are mounted at the top of a pair of longitudinally extending, laterally spaced apart storage shelves 16 and 18. The dual tracks 12 and 14 are mounted on the front surface or side of the storage shelves 16 and 18 by means of a plurality of longitudinally spaced brackets 20 or end mounts 22. The storage shelves 16 and 18 are mounted on the floor 96 of a building, store or warehouse, with the space between the shelves 16 and 18 defining an aisle or aisle way 24.

As used herein, the term "longitudinal direction" is defined as extending parallel to the laterally spaced apart storage shelves 16 and 18. The term "lateral direction" is defined as extending laterally between the storage shelves 16 and 18.

The track system 10 includes an overhead roller carriage or roller structure 26 which is mounted for longitudinal movement along the guide tracks or rails 12 and 14. The roller carriage 26 includes a pair of side walls or members 30 and 32 which are laterally spaced apart and are parallel to one another as illustrated in FIGS. 1, 2, 3 and 8. The roller carriage 26 further includes a pair of telescopically adjustable tubular supports including a first support 34 and a second support 35. The first support 34 includes a pair of tubular members 36 and 38, with tubular member 36 slidable within tubular member 38. The second support 35 includes a tubular member 40 slidable within the tubular member 42. The members 36, 38, 40 and 42 are provided at the ends thereof with means for securing the adjustable first and second supports 34, 35 to the side members 30, 32 in order to fit or to adjust to the spacing between the laterally spaced apart shelves 16 and 18.

The longitudinal ends of each of the side members 30 and 32 of the roller carriage 26 has mounted thereon a pair of roller sets 44 and 46, thereby providing two pairs of rollers on each side member 30, 32. The rollers are movable along their respective dual guide tracks 12 and 14. The roller carriage 26 is mounted for movement in the longitudinal direction parallel to the shelves 16 and 18.

Each roller set 44, 46 (total of 4) has a bracket 47 attached to one of the side walls 30, 32. Mounted on each bracket 47 is an upper roller 48 and a lower roller 50. Two pairs of roller sets 44, 46 are carried on each of the side walls 30, 32 and have annular curved surfaces which are received on or engageable with the dual tracks 12, 14. The guide tracks 12 and 14 are of circular cross-section.

The track system 10 includes a ladder 52 having a frame 54. The ladder 52 has a first side 55 and a second side 56. Each side 55, 56 has a pair of side rails 58 and 60. The side rails 58 and 60 support the vertically spaced apart steps or stairs 62. The upper most step 62 is integral with a ladder platform 66 having a lateral support structure 68 integral with the ladder frame 54. The upper ends of the side rails 60 near the top step 62 extends rearwardly and abuts the other side rail 58. The side rails 58 are connected near the top by a cross rail 70 and at the top of the side rails 58 are connected by a cross rail 72.

Hand rails 74 are laterally spaced apart and parallel to one another and are carried by the frame 54 of the ladder 52. The hand rails 74 provide a grip for a person climbing the ladder steps or stairs 62 and also lie in the plane 56 in order to abut the front surface of shelf 16 when the ladder 52 is pivoted and stored at one side of the aisle 24 as illustrated in FIG. 2.

The ladder 52 includes a mounting structure or bar 80 which provides support for a pair of roller sets 82. One roller set 82 has a bracket 84 which is welded or otherwise secured to one end of the mounting bar 80. The bracket 84 maintains the upper and lower rollers 86 and 88 in a vertically spaced relationship. The rollers 86, 88 are of arcuate configuration and are designed to ride along the first support 34. The other roller set 82 is mounted on a bracket which is welded to the other end of the mounting bar 80.

Figure 9:
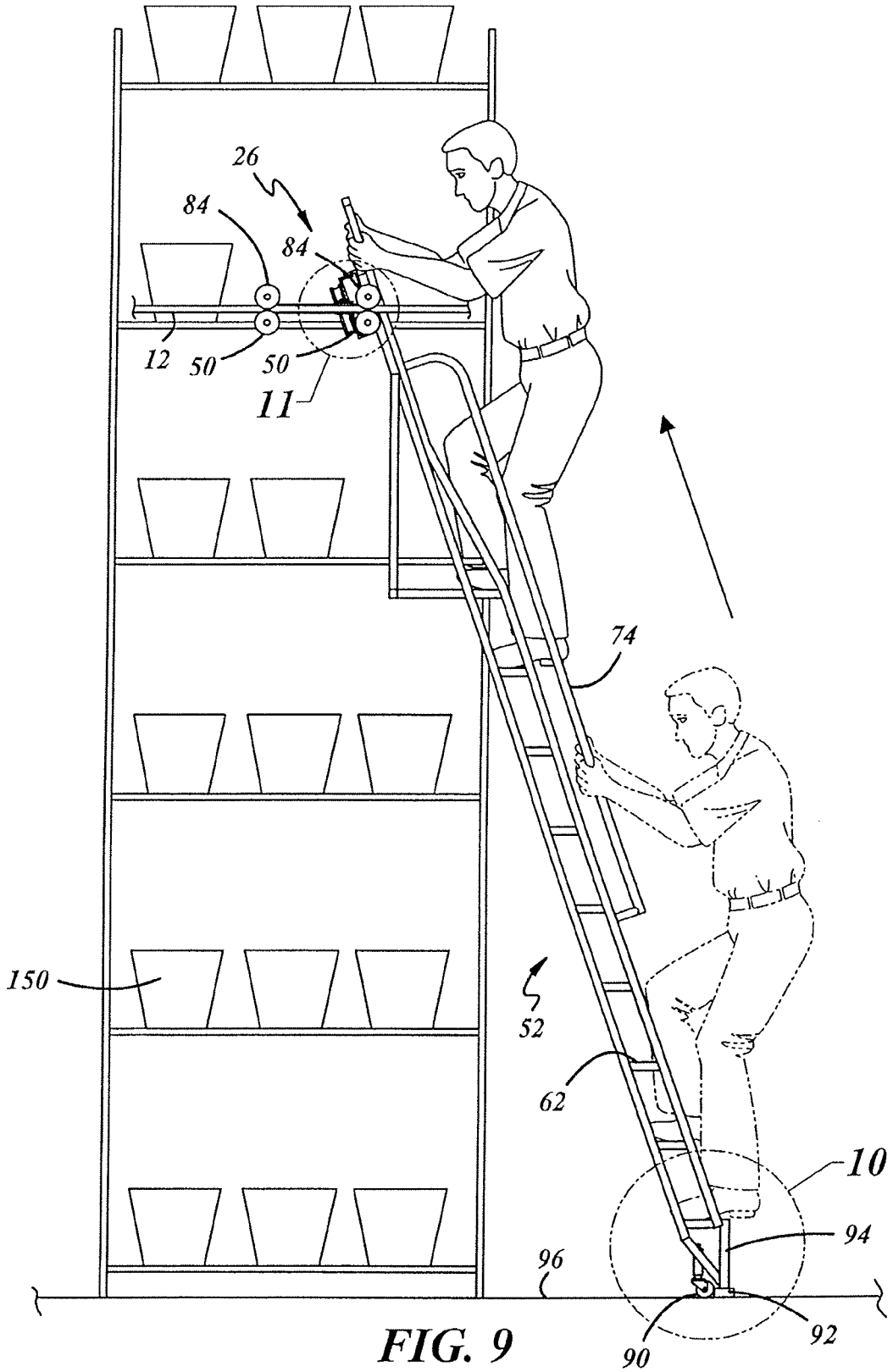
FIG. 9 is a side view of the ladder system ready for use, with a worker initially stepping on the lower step in order to depress the spring loaded caster wheels and to urge the fixed rubber pads mounted to the ladder style against the floor to thereby prevent the lower end of the ladder from moving, and with the worker climbing the stairs of the ladder and thereafter applying the brake mechanisms of the carriage assembly as a result the weight of the worker on the ladder to thereby prevent the upper end of the ladder from moving longitudinally.
Figure 10:
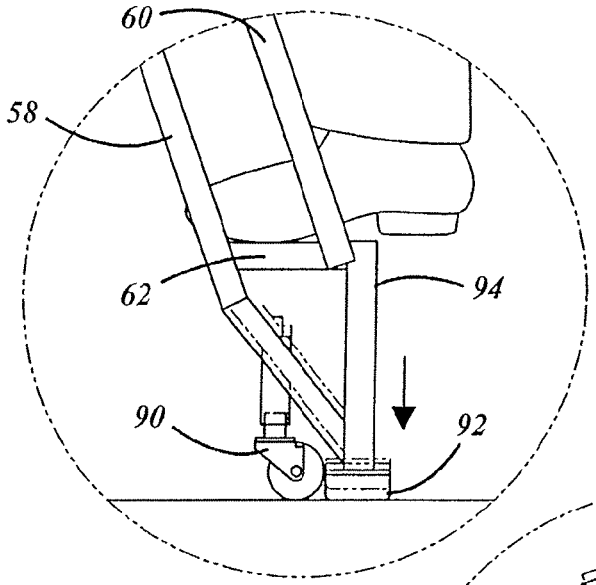
FIG. 10 is a fragmentary view of the lower portion of the ladder showing an enlargement of the area of circle 10 of FIG. 9 and illustrating the pair of fixed rubber pads being lowered due to the weight of the worker, thus fixing and thereby holding the roller end of the ladder against movement.
Figure 11:
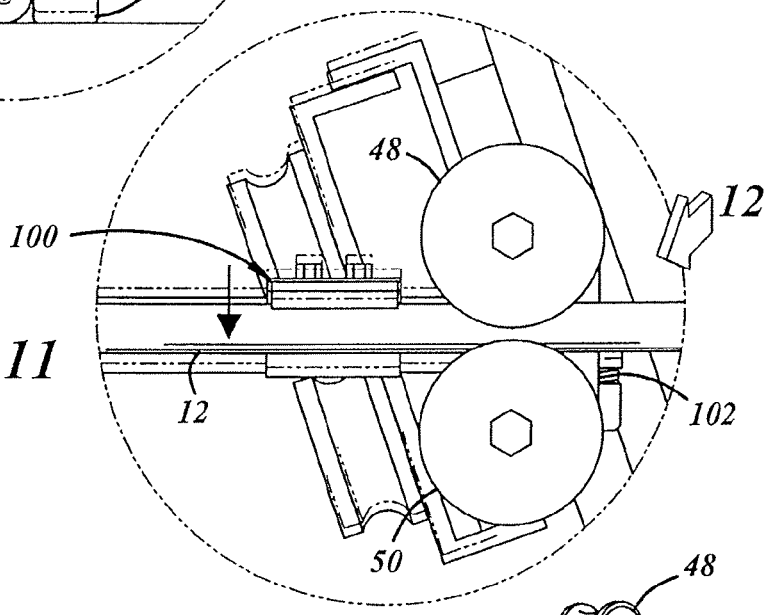
FIG. 11 is a view of the upper portion of the ladder showing an enlargement of the area of circle 11 of FIG. 9 and illustrating the application of the brakes to the upper end of the ladder system as a result of the weight of the worker.
Figure 12:
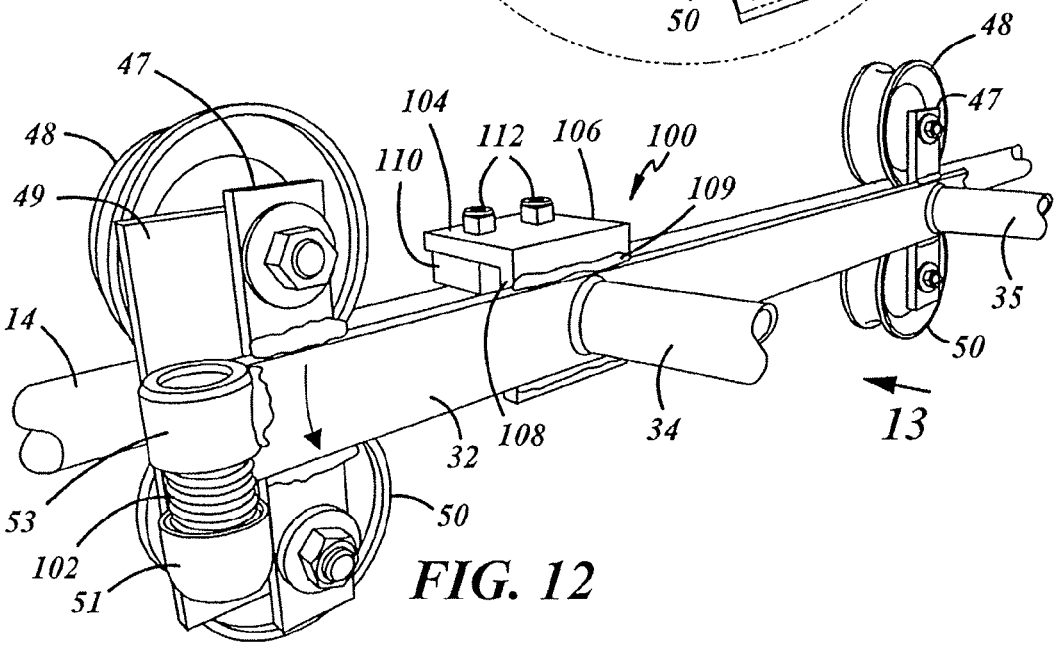
FIG. 12 is a fragmentary perspective view of the upper portion of the ladder system looking in the direction of arrow 12 of FIG. 11 and illustrating the roller mounting structure, upper brake mechanism and spring assembly.

The lower end of the ladder 52 is provided with a pair of stop or brake mechanisms 89 which includes a pair of spaced apart spring-loaded casters 90 and a pair of rubber pads 92 which are carried by the bottom ends of a U-shaped support 94 which is secured to the ladder frame 54. When the ladder 52 is not in use, the spring-loaded casters or wheels 90 are designed to roll along the floor 96, with the bumpers 92 raised and spaced from the floor 96. As shown in FIGS. 9 and 10, when a person steps on the ladder step 62, the springs within the caster wheels 90 are compressed, thereby lowering the rubber pads 92 of the ladder 52 onto the floor 96 to prevent movement of the ladder 52 at the bottom thereof.

The roller carriage 26 differs from the roller carriage described in my U.S. Pat. No. 6,619,427 by providing in addition, a pair of brake mechanisms 100 and a pair of compression springs 102 as best illustrated in FIGS. 12-17. Each brake mechanism 100, includes an L-shape bracket 104 having a first leg 106 and a second leg 108 perpendicular to the first leg 106. Brake pad 110 is made from rubber or other compressible material and is secured to the underside of the first leg 106 by means of a pair of fastening devices (nuts and bolts) 112. The second leg 108 is welded at 109 to the outer side or surface of the side members 30, 32.

Thus the locating means also includes the pair of braking mechanisms 100. One braking mechanism 100 is connected to each of the side members 30, 32 and overlies and is engageable with one of the first and second guide tracks 12, 14 when subjected to a load of a person on the ladder 52 during use. This prevents movement of the ladder 52 at the top when a force is applied by the worker whether intentionally or unintentionally.

Figure 13:
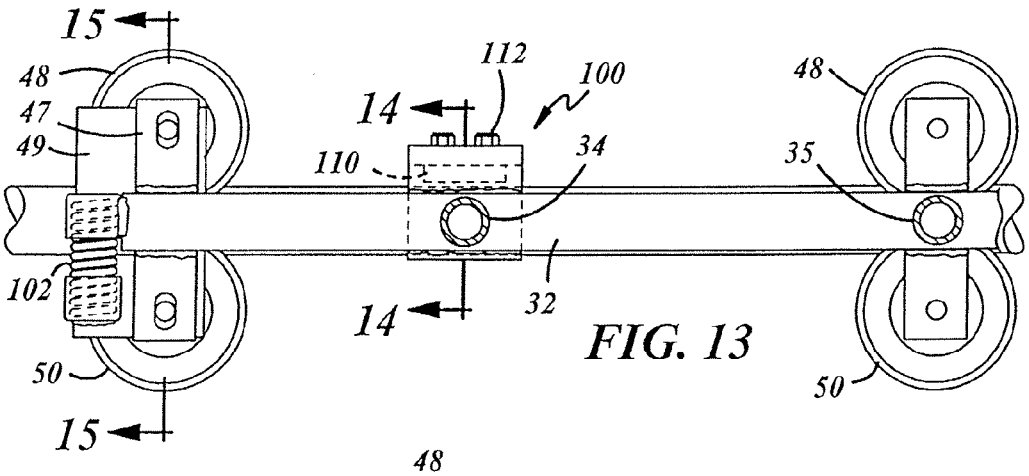
FIG. 13 is an elevational view of the upper part of the ladder system looking in the direction of arrow 13 of FIG. 12.
Figure 15:
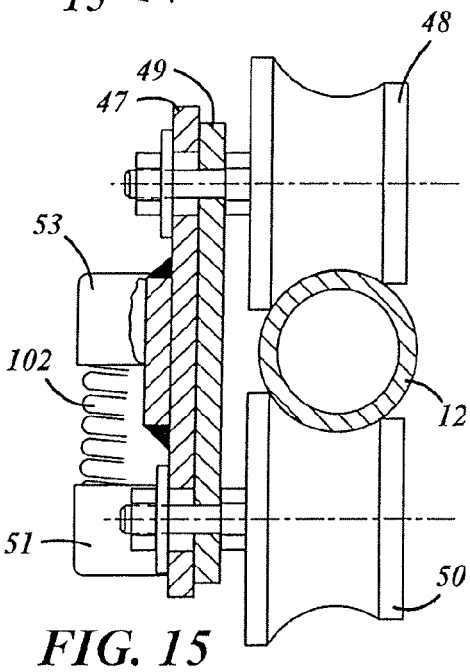
FIG. 15 is a partial sectional view through the guide track and the mounting structure for the rollers, taken on the line 15-15 of FIG. 13.
Figure 14:
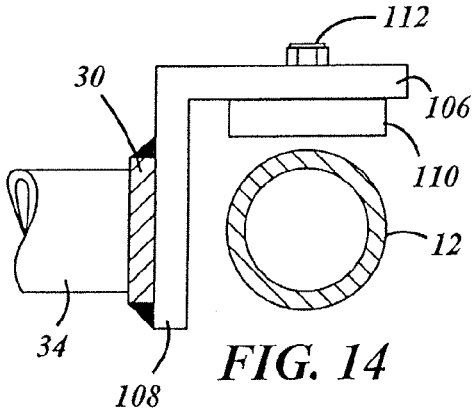
FIG. 14 is a sectional view through the brake mechanism when unloaded, and the guide track taken on the line 14-14 of FIG. 13.
Figure 16:
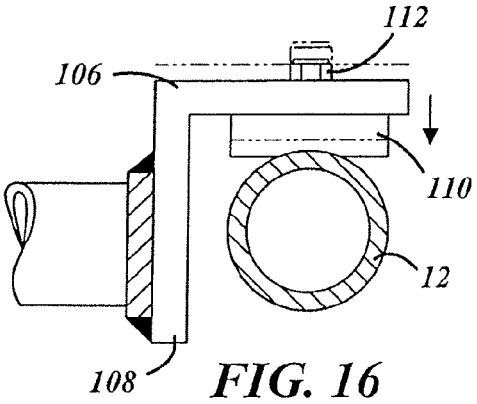
FIG. 16 is a view similar to FIG. 14 but illustrating the lowering of the brake pad against the guide track when the weight of the worker is applied to the ladder thereby compressing the rubber brake pad against the guide track and thereby preventing the ladder from moving longitudinally.
Figure 17:
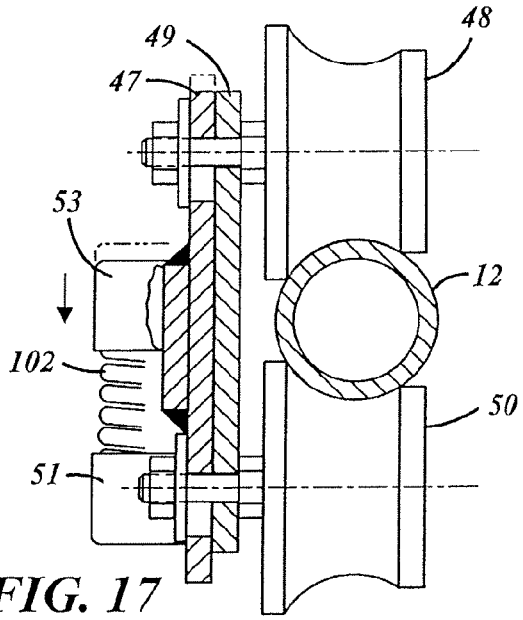
FIG. 17 is a view similar to FIG. 15 and illustrating the lowering of the upper roller when a force is applied to the upper end of the ladder thereby compressing the rubber brake pad against the guide rail or track and also compressing the return spring.

A side plate 49 (FIG. 18) is located adjacent a pair of upper and lower rollers 48, 50 near one end of each side member 30, 32. Each side plate 49 is provided with a lower spring cup 51. An upper spring cup 53 is welded or secured to the end of the mounting bar or side member 30, 32 and is located above and is spaced from the lower spring cup 51. The compression spring 102 has opposite end portions received in the opposing upper and lower cups 51, 53 as illustrated in FIGS. 13, 15 and 17.

As mentioned previously, when the user applies a force to the ladder 52, the upper braking mechanisms 100 are applied urging the brake pads 110 into engagement with the dual tracks 12, 14 while simultaneously compressing the compression springs 102. When the worker removes himself from the ladder, the compression springs 102 release the brake pads 110 from the dual tracks 12, 14.

The mounting structure for the ladder 52 which includes the mounting bar 80 and a pair of roller sets 82 engageable with the first rod or support 34, has been provided with locating means including a lateral brake 116 (FIG. 4) which is pivotally carried by the ladder frame 54 and is engageable with the first support 34 to prevent lateral movement of the ladder 52 and roller carriage 26.

Figure 7:
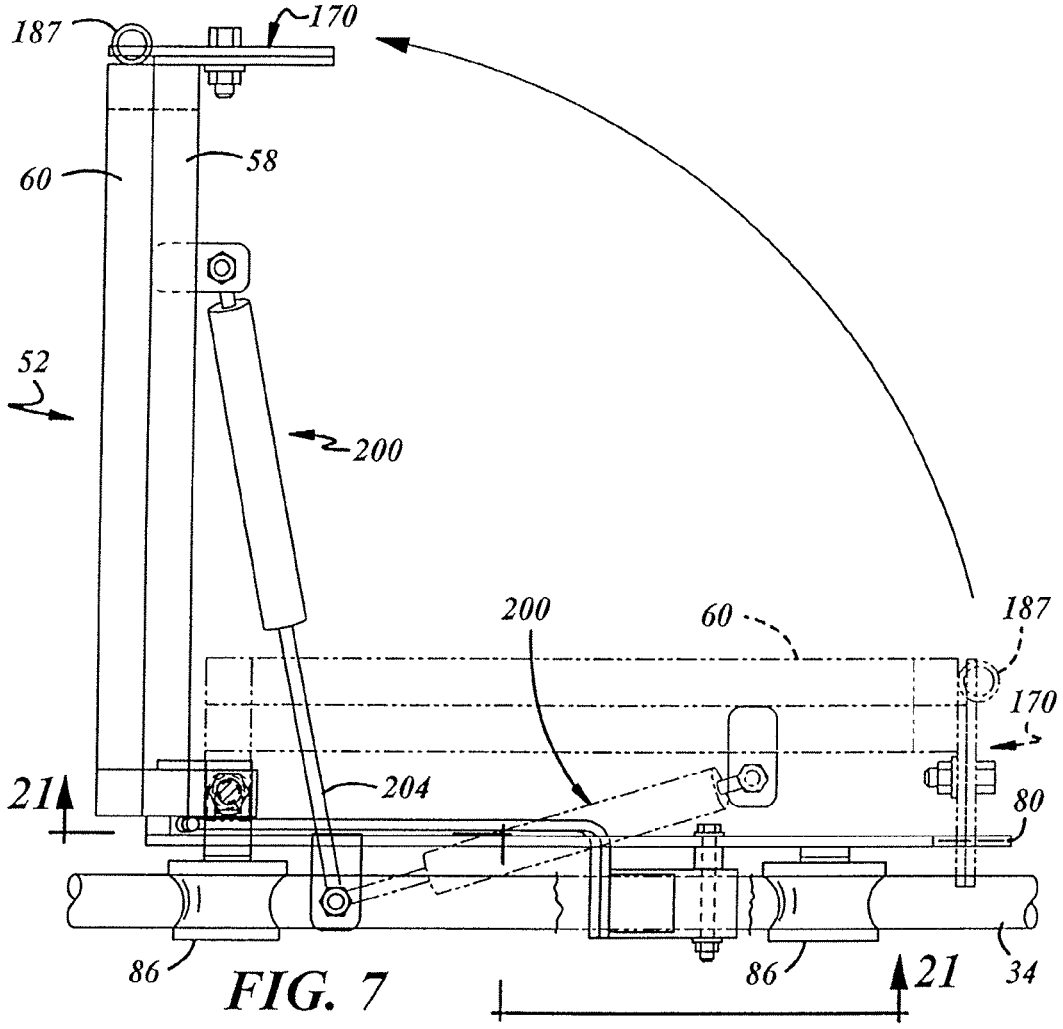
FIG. 7 is a top view of the ladder and mounting plate before and after the latch has been released from the mounting plate and the ladder turned about the pivot means to one side of the aisle by the gas cylinder.
Figure 8:
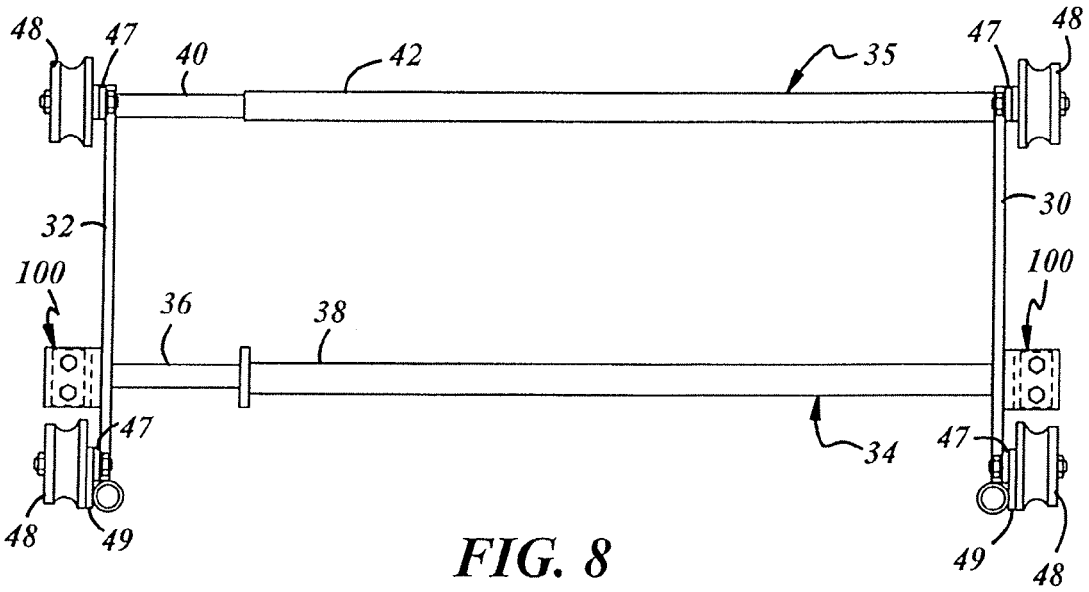
FIG. 8 is a plan view of the telescopic roller carriage assembly showing a pair of brake mechanisms.

As best illustrated in FIGS. 4-7 inclusive, the ladder 52 near the upper end of the first side 55 is provided with a pivot mechanism, assembly or means 152. The pivot mechanism 152 includes a C-shape bracket 154 which is secured to the ladder rail 58 and a corresponding C-shape bracket 156 is secured to the mounting bracket 154 previously described. An elongated bolt or mounting member 158 extends through the overlapping upper flanges 160, 162 of bracket 154, 156 and the overlapping lower flanges 161, 163 of said bracket 154, 156. The bolt 158 is secured on the lower end by nut 164 as illustrated in the FIGS. 6 and 21. A compression spring 166 is coiled around portions of the bolt 158, with the spring 166 having ends 168, 170. The spring end 168 abuts the face of the mounting bar 80. The other spring end 168 contacts the ladder side rail. When the ladder 52 is unlatched from the mounting bar 80, to be subsequently described, it swings about the pivot mechanism or assembly 152 from the position illustrated in FIGS. 4-6 inclusive to the position illustrated in FIG. 7, the folded position at one side of aisle 24 as in FIG. 2. The mounting bar 80 forms an abutment for the ladder 52 as best illustrated in FIG. 7.

The lateral brake 116 is illustrated and described in connection with FIGS. 21-23. The lateral brake 116 includes a brake housing 118 pivoted at 120 to the ladder structure. Housing 118 includes a brake pad 122, made from rubber or other suitable compressible material and a longitudinally extending arm 124. The arm 124 is integral with housing 118 and has one end 126 extending into the space between the spaced brackets 154, 156 of pivot mechanism 152. The end 126 of arm 120 has a formation 130 for receiving an end of a cable 132. The other end 128 of arm 124 is integral with housing 118. A force is applied to the actuating cable 132 to release the lateral brake 116 in order to permit lateral movement of roller carriage 26 on the first supports 34.

The lateral brake 116 is maintained in engagement with the first support 34 by the compression spring 166. In summary, the lateral brake 116 is normally engaged with the first support 34 to prevent lateral movement of the ladder 52. This is accomplished by the compression spring 166 which maintains the brake pad 122 in engagement with the track or first support 34 until the cable 132 is pulled to release the lateral brake 116 and thereby permit adjustment of the ladder 52. After that occurs, the cable 132 is released and the spring 166 forces the arm 124 in a clockwise direction about pivot 120, as viewed in FIG. 21, to release the compression of the springs 166 and apply the lateral brake 116.

Figure 5:
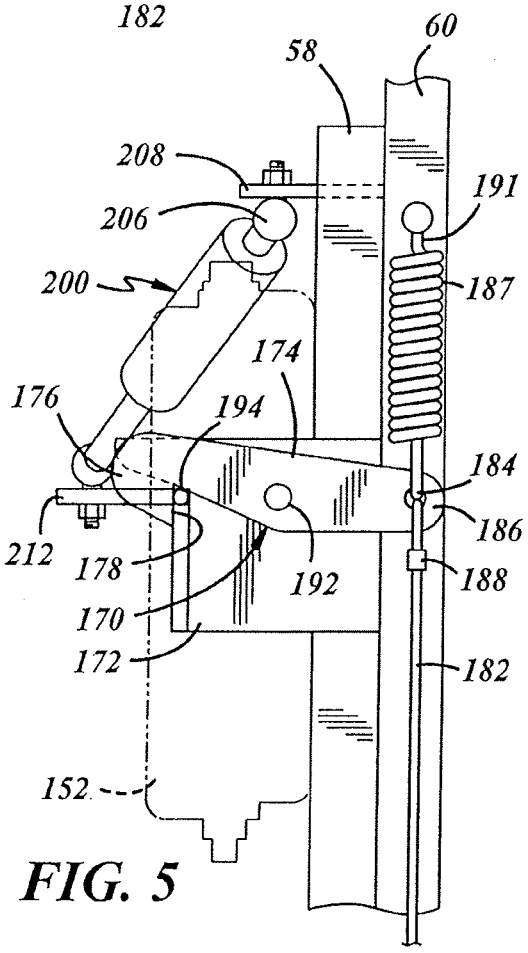
FIG. 5 is a fragmentary side elevational view looking in the direction of arrows 5-5 of FIG. 4.
Figure 6:
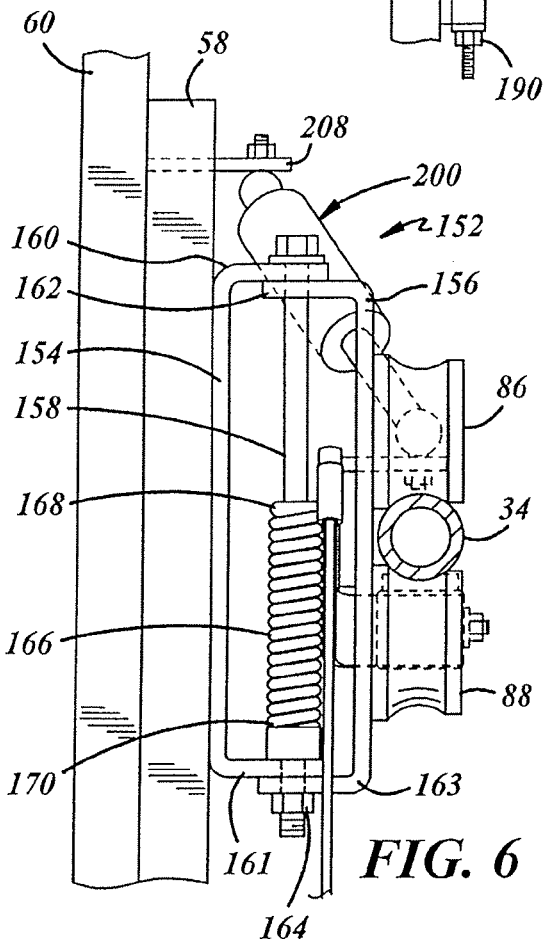
FIG. 6 is a side elevational view looking in the direction of arrows 6-6 of FIG. 4.

The other side of the ladder 52 is provided with a latch mechanism 170, as shown in FIG. 5. The latch mechanism 170 includes a latch mounting plate 172 and a latch or lever 174. The latch plate 172 is attached to the ladder side rails 58, 60 where they abut near the top of the ladder 52. The latch 174 has on one end a head 176 provided with a latching surface 178. The other end 180 of the latch 174 provides an anchor for an actuating cable 182. An end of the cable 182 extends through an opening 184 provided in the latch end 186, with the ends thereafter tied to the main cable 182 in an appropriate fashion by means of a cable tie or nut 188.

Figure 4:
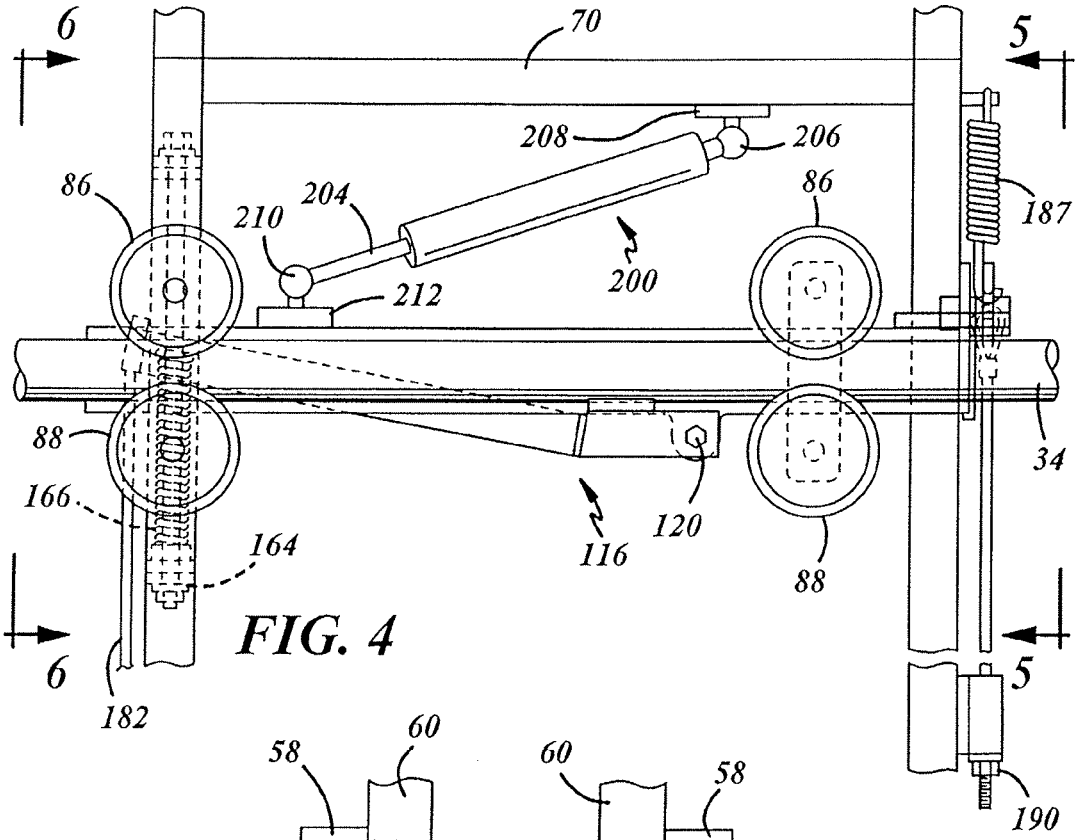
FIG. 4 is a fragmentary elevational view, with parts broken away, of the upper portion of the ladder system showing the gas cylinder and the lateral brake.

The other end of the cable 182 is retained by a fastening device 190 as illustrated in FIG. 4. A pivot 192 is mounted between the head 176 and anchor end of the latch 174. The pivot may be in the form of a bolt which extends through aligned openings provided in the lever 174 and the plate 172. A biasing coil spring 187 has one end 189 connected to the latch end 186 and the other end 191 connected to side rail 60 to thereby bias the latch 174 to a latch position, with the latching surface 178 engaging the rod 198 carried by the mounting bar 80. The top surface of the mounting bar 80 at the actuating end is provided with a relatively short rod 194 of generally circular configuration. The rod 194 overlies a cut-out or notch provided in the mounting bar 80. The rod 194 is engaged by the latching surface 178 of latch 174 as shown in FIG. 5.

Figure 3:
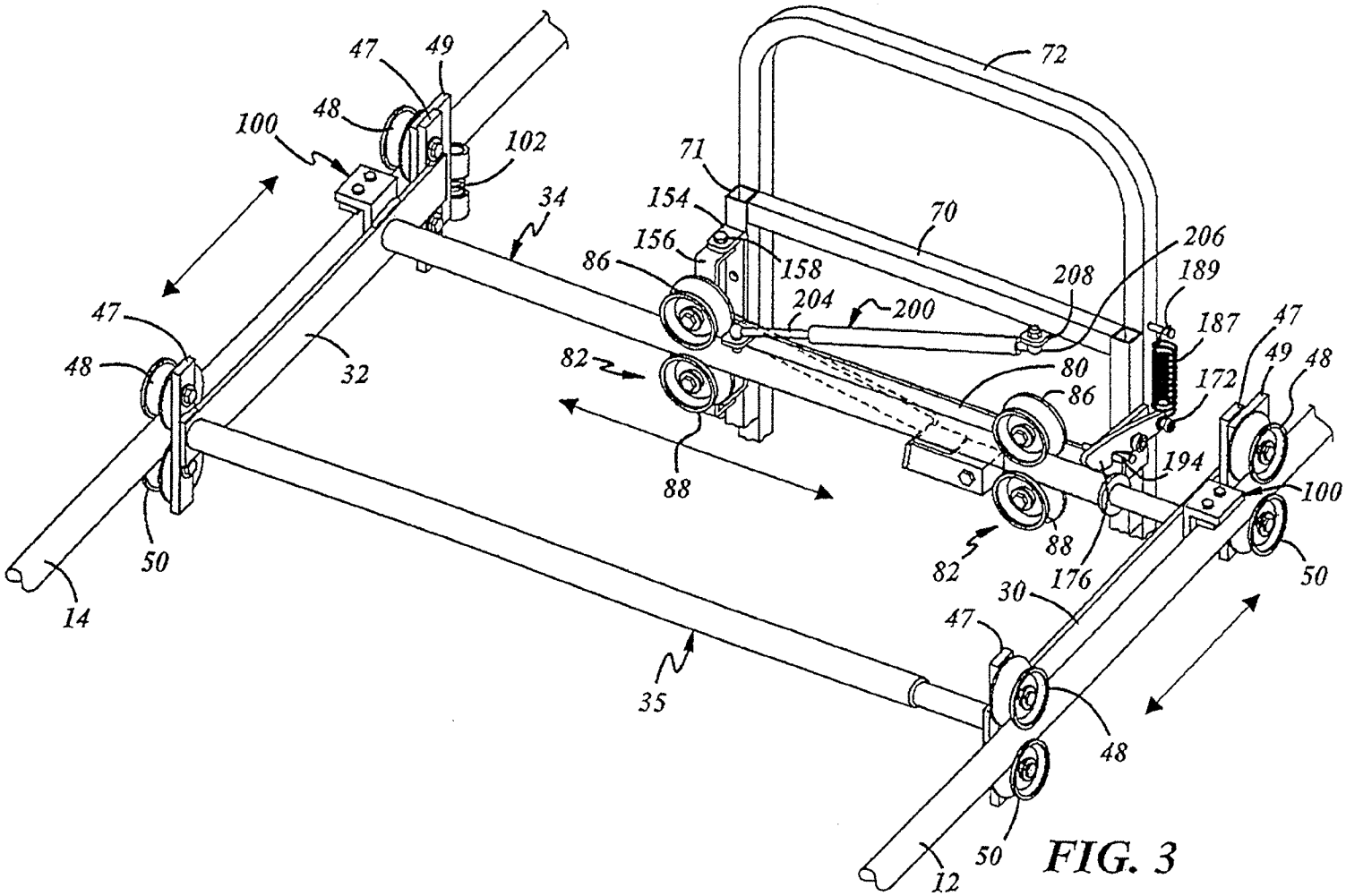
FIG. 3 is a fragmentary front perspective view, with parts broken away, of the upper part of the ladder and mounting structure and illustrating a gas cylinder for pivoting the ladder to one side of the aisle and a spring-biased latch for retaining the ladder in position ready for use.

The present disclosure includes a way to mechanically move the ladder system 10 to the stored position against one of the shelving 16. This design involves a use of a gas cylinder or gas spring 200. The gas spring 200 includes a cylinder 202 having a rod 204 movable therein. The cylinder has one end 206 attached to a bracket 208 carried by the rail 70. The piston rod has an outer end 210 affixed to a bracket 212 carried by the support as best illustrated in FIG. 3.

The gas spring 200 is a self-contained, hermetrically-sealed hydro-pneumatic linear actuator which contains pressurized nitrogen gas which pushes or directs the entire ladder section up and to the right as viewed in FIG. 2. The ladder 50 comes to rest against the face of the shelving 16 as shown in FIG. 2 and the ladder 52 is held in that position at one side of the aisle 26 against the shelving 16 by the gas cylinder 200. In order to use the ladder 52 it is necessary for the ladder 52 to be pushed back to the normal position until the latch 174 snaps shut and retains the ladder 52 in position for use. The use of the gas cylinder 200 permits the ladder 52 to be easily moved out of the way when necessary where crowded, narrow aisles exist.

Figure 20:
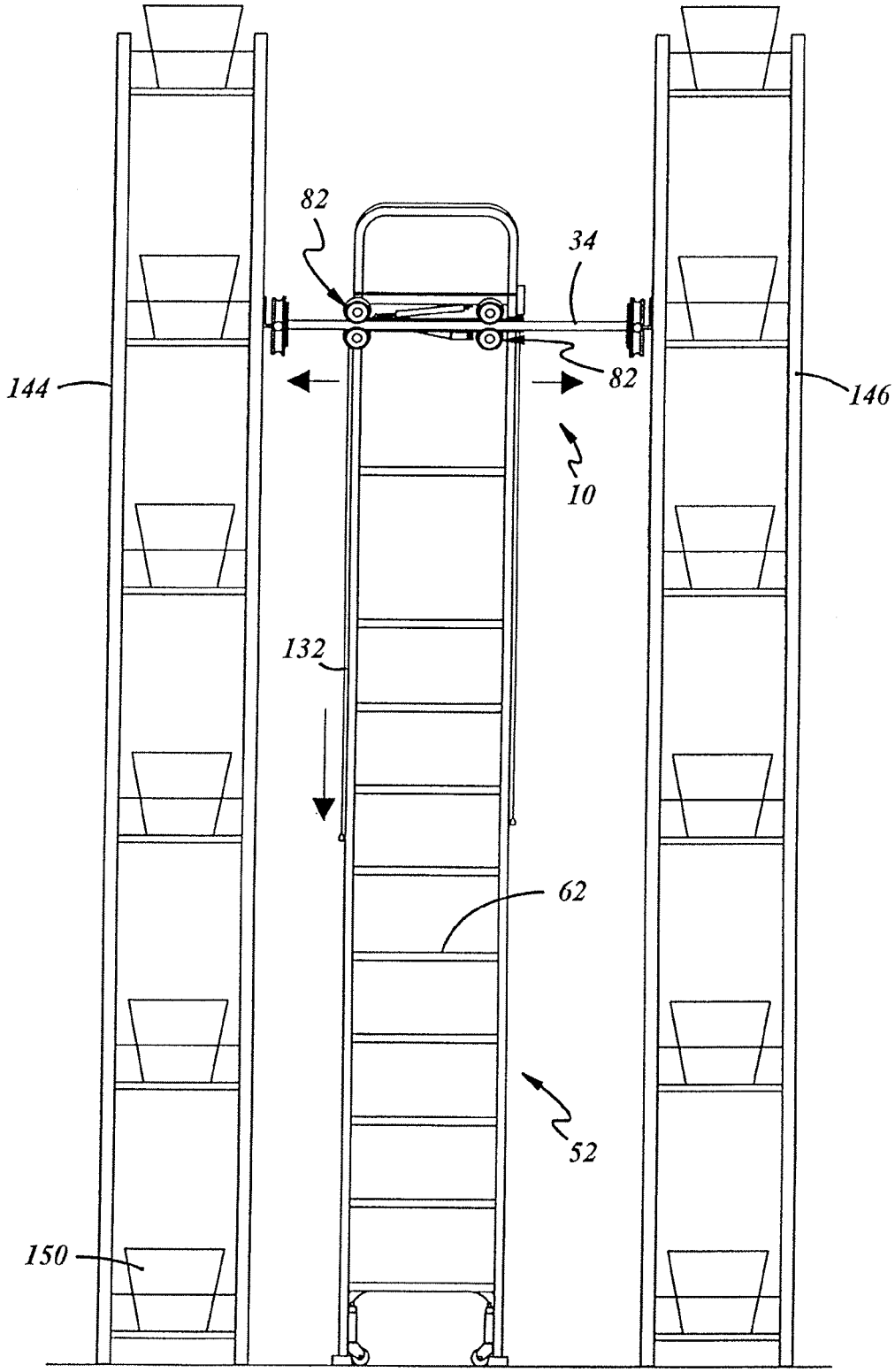
FIG. 20 illustrates a front elevational view of the ladder in an aisle between laterally spaced apart shelves, with the ladder moveable laterally in either direction prior to the application of the lateral brake by releasing the positioning cable.

FIGS. 9 and 20 shows the track system 10 for a ladder 52, with the track system mounted on the first support 34 between a pair of modified shelves 144 and 146 having vertically spaced storage compartments with packages 150 therein.

It should also be understood that other types of ladders such as those having safety structures with or without platform or gates, may incorporate the novel features of the present disclosure and would come within the scope of the claims of this disclosure. Moreover, the ladder may be made from various materials such as metal or wood.

Although a preferred embodiment of the present disclosure has been disclosed, it should be understood that a worker of ordinary skill in the art may recognize that certain modifications would come within the scope of the disclosure. The followings claims should be studied in order to determine the scope and content of this disclosure.

The invention claimed is:

1. A ladder system comprising:

an overhead track system including a first guide track, a second guide track, a carriage operatively configured to move longitudinally in a longitudinal direction parallel to and along the first and second guide tracks and to move laterally in a lateral direction generally transverse to the longitudinal direction between the first and second guide tracks;

the carriage having a first side wall, a second side wall, and a rod directly extending between the first and second side walls;

a ladder pivotally mounted to the carriage of the overhead track system thereby forming a first pivot connection therebeteween, the ladder operatively configured to move along the rod in the lateral direction;

a lateral carriage brake operatively configured to prevent said movement of the ladder along the rod in the lateral direction, said lateral carriage brake including a lateral brake housing having a first housing end and a second housing end opposite the first end wherein the housing is pivotally connected to the carriage at the first housing end to form a second pivot connection, the lateral carriage brake further including an arm having a proximal end connected to and integral with the housing at the second housing end, the arm further including a distal end opposite the proximal end, the lateral brake housing including a lateral brake pad disposed between the second pivot connection and the distal end of the arm wherein the lateral brake pad is configured to engage the rod; and a latch carried by the ladder and moveable between an engaged position and a disengaged position with the carriage, the latch, when in the engaged position is connected with the carriage and operatively configured to hold the ladder in a latched position, and when in the disengaged position from the carriage, operatively configured to allow the ladder to rotate about the first pivot connection.

2. The ladder system of claim 1 wherein the rod of the carriage is a first rod, the carriage further including a mounting bar and a second rod, the first and second side walls being moveably affixed to the first and second guide tracks respectively, the first and second rods each being attached to the first side wall at a first end of the first and second rods, and being attached to the second side wall at a second end of the first and second rods, the mounting bar being moveably affixed to the first rod and the ladder being pivotally mounted to the mounting bar about the first pivot connection.

3. The ladder system of claim 2 wherein the carriage includes a plurality of rollers disposed on each of the first and second side walls, the plurality of rollers operatively configured to engage with the first guide track and the second guide track for facilitating the longitudinal movement of the carriage in the longitudinal direction.

4. The ladder system of claim 1 wherein the carriage further includes a mounting bar coupled to the rod via a plurality of mounting bar rollers wherein the mounting bar rollers are configured to facilitate the lateral movement of the ladder in the lateral direction along the rod between the first side wall and the second side wall, and wherein the lateral carriage brake is configured to engage the rod to prevent the lateral movement of the ladder in the lateral direction.

5. The ladder system of claim 1 wherein the lateral carriage brake further comprises:

a spring disposed in relation to the distal end of the arm configured to rotationally urge the distal end of the arm about the second pivot connection to force the lateral brake pad into engagement with the rod.

6. The ladder system of claim 5 wherein said spring comprises a compression spring having a first spring end fixed relative to the carriage and a second, opposite spring end connected to the distal end of the arm.

7. The ladder system of claim 6 wherein the compression spring is compressed such that a restorative force of the spring bears on the distal end of the arm so that the lateral brake pad is urged into engagement with the rod.

8. The ladder system of claim 6 wherein the arm has a formation at the distal end thereof configured to receive an actuating cable to release the lateral carriage brake so as to permit the lateral movement of the carriage in the lateral direction.

9. The ladder system of claim 8 wherein:

when the actuating cable is pulled in a first direction to further compress the spring, the lateral brake pad is removed from engagement with the rod, thereby allowing lateral movement of the carriage in the lateral direction.

10. The ladder system of claim 1 further comprising a longitudinal carriage brake comprising at least one longitudinal brake pad operatively configured to engage one of the first guide track and the second guide track.

11. The ladder system of claim 1 wherein the rod is adjustable in length.

12. The ladder system of claim 11 wherein the rod comprises a pair of tubular members wherein one of the pair of tubular members is slidable within the other one of the pair of tubular members.

13. A ladder system comprising:

an overhead track system including a first guide track, a second guide track, a carriage operatively configured to move longitudinally in a longitudinal direction parallel to and along the first and second guide tracks and to move laterally in a lateral direction generally transverse to the longitudinal direction between the first and second guide tracks;

the carriage having a first side wall, a second side wall, and a rod directly extending between the first and second side walls;

a ladder pivotally mounted to the carriage of the overhead track system thereby forming a pivot connection therebeteween, the ladder operatively configured to move along the rod in the lateral direction;

a lateral carriage brake operatively configured to prevent said movement of the ladder along the rod in the lateral direction; and a latch carried by the ladder and moveable between an engaged position and a disengaged position with the carriage, the latch, when in the engaged position is connected with the carriage and operatively configured to hold the ladder in a latched position, and when in the disengaged position from the carriage, operatively configured to allow the ladder to rotate about the pivot connection, further comprising a locating arrangement including at least one stop mechanism at a bottom end of the ladder including a spring-loaded caster and a rubber pad, the locating arrangement configured to cause a person disposed on the ladder to compress a spring of the spring-loaded caster to urge the rubber pad against a floor to prevent movement of the ladder at the bottom thereof.

14. A ladder system comprising:

an overhead track system including a first guide track, a second guide track, a carriage operatively configured to move longitudinally in a longitudinal direction parallel to and along the first and second guide tracks and to move laterally in a lateral direction generally transverse to the longitudinal direction between the first and second guide tracks;

the carriage having a first side wall, a second side wall, a mounting bar, a first rod and a second rod, the first and second side walls being moveably affixed to the first and second guide tracks respectively, the first and second rods each being attached to the first side wall at a first end of the first and second rods, and being attached to the second side wall at a second end of the first and second rods, the mounting bar being moveably affixed to the first rod;

a ladder pivotally mounted to the mounting bar by a first pivot connection therebeteween, the ladder operatively configured to move along one of the rods in the lateral direction;

a lateral carriage brake operatively configured to prevent said movement of the ladder along said one of the rods in the lateral direction, the lateral carriage brake comprising:

a lateral brake housing having a first housing end and a second housing end, said lateral brake housing including a lateral brake pad wherein the housing is pivotally connected on the first housing end to the carriage at a second pivot connection;

an arm having a proximal end connected to and integral with the housing at the second housing end, the arm further having a distal end, wherein the lateral brake pad is disposed between the second pivot connection and the distal end of the arm;

a spring disposed in relation to the distal end of the arm configured to rotationally urge the distal end of the arm about the second pivot connection to force the lateral brake pad into engagement with said one of the rods; and a latch carried by the ladder and moveable between an engaged position and a disengaged position with the carriage, the latch, when in the engaged position is connected with the carriage and operatively configured to hold the ladder in a latched position, and when in the disengaged position from the carriage, operatively configured to allow the ladder to rotate about the first pivot connection.

15. The ladder system of claim 14 wherein said spring comprises a compression spring having a first spring end fixed relative to the carriage and a second, opposite spring end connected to the distal end of the arm.

16. The ladder system of claim 14 wherein the first rod is adjustable in length.

* * * * *